US005309605A

United States Patent [19]

Sato

[11] Patent Number: 5,309,605

[45] Date of Patent: May 10, 1994

[54] SPRING CLIP

[76] Inventor: Hisao Sato, Fujimidai-Mansion 2002, 29-10, Nukui 1-Chome, Nerima-Ku, Tokyo, Japan

[21] Appl. No.: 18,408

[22] Filed: Feb. 17, 1993

[30] Foreign Application Priority Data

Apr. 30, 1992 [JP] Japan ..... 4-36136[U]

[51] Int. Cl.[5] ..... B42F 1/02

[52] U.S. Cl. ..... 24/67.9; 24/563

[58] Field of Search ..... 24/563, 545, 555, 67.9, 24/67.3, 67.5; 411/523

[56] References Cited

U.S. PATENT DOCUMENTS 4,532,680 8/1985 Hashimoto ..... 24/67.5 X
4,883,397 11/1989 Dubost ..... 24/563 X
4,947,524 8/1990 Chang ..... 24/563 X

*Primary Examiner*—James R. Brittain
*Attorney, Agent, or Firm*—Kanesaka & Takeuchi

[57] ABSTRACT

Disclosed is a spring clip formed by bending a single sheet of elastic metal plate which comprises: a base portion having an opening formed in a central portion thereof; a rising-up portion raised up substantially vertically from the base portion; and a grasping portion bent at an acute angle from the rising-up portion toward the base portion so as to cooperate with the base portion to grasp sheets of paper or the like between the grasping portion and the base portion, the grasping portion including a contact portion formed at a portion facing at least an outer circumferential portion of the opening of the base portion for contacting with the sheets of paper or the like, and a lead-in portion extended from the contact portion to a top end portion and bent so as to come away from the base portion. The attachment of the spring clip to the sheets of paper or the like can be performed easily only by making the base portion abut onto the back surface side of the sheets of paper or the like, and inserting the lead-in portion onto the sheets of paper or the like from the edge portion of the latter.

8 Claims, 3 Drawing Sheets

SPRING CLIP

BACKGROUND OF THE INVENTION

1. Field of the Invention

The present invention relates to a clip for binding a plurality of loose sheets of paper or the like, and particularly relates to a spring clip formed by bending an elastic metal plate to give thereto such an elasticity that bent end portions thereof abut against each other, and the bent end portions abutting against each other can be opened easily only by the force of fingers.

2. Description of the Related Art

To bind a plurality of loose sheets of paper or the like without injuring them, à Gem clip has bee used broadly. Such a Gem clip is formed of a single elastic wire in such a manner that the single elastic wire is formed into two continuous ring portions of different sizes which are disposed on one and the same plane so that sheets of paper or the like can be inserted between the two ring portions. Various kinds of such Gem clips having different wire diameters and sizes have been prepared so that a desired one of those clips can be selected in accordance with the thickness of the sheets of paper or the like to be bound.

However, since such a Gem clip is formed by bending a wire, the ring portions must be made elliptic to ensure enough elasticity to bind sheets of paper or the like, and the ellipses must be elongated longitudinally, so that there has been an disadvantage that not only a Gem clip elongated longitudinally becomes a hindrance when the bound sheets of paper or the like are to be opened, but also, when sheets of thick paper or the like are bound, the two ring portions come into point contact with the paper at the edge portions of the sheets of paper or the like so that the sheets of paper or the like may come off from the clip easily.

In order to eliminate such a disadvantage of a Gem clip, there has been proposed a clip which is formed in such a manner that an elastic plate-like member is bent to form an isosceles triangle in longitudinal section so that two grasping portions are formed so as to abut against each other at their extremities, and the extremities of the grasping portions are bent into ring-like shapes to thereby constitute a clip body. Two levers each formed by bending a metal rod-like member into a U-letter shape are prepared, and both the end portions of the respective levers are rotatably inserted into the ring-like portion of one of the grasping portions so that the two grasping portions can be opened about the angled portion of the clip body as a fulcrum based on the principle of lever by means of the levers to thereby allow insertion of sheets of paper or the like to be bound. In such a spring clip, the thickness as a gusset is formed in advance so that it is possible to bind thicker documents than those can be bound by a Gem clip.

However, not only it is necessary to prepare three parts, that is, one clip body and two levers, but it is necessary to provide an assembling work to insert end portions of the two levers into ring-like portions of the clip body. It is therefore impossible to provide a spring clip at a low price. Further, there has been a further disadvantage in that such a spring clip is bulk because of the two levers projecting from its clip body, etc.

SUMMARY OF THE INVENTION

It is therefore an object of the present invention to provide a spring clip which can be formed of a single metal plate by means of press working or the like, and in which its end portions abutting against each other can be opened only by fingers to bind documents or the like therebetween.

It is another object of the present invention to provide a spring clip in which its end portions can be opened by an extremely weak force, and documents or the like can be bound with a strong grasping force if fingers are released from the spring clip.

In order to attain the above objects, according to an aspect of the present invention, the spring clip formed by bending a single sheet of elastic metal plate for binding a plurality of sheets of paper or the like together, comprises: a base portion having an opening formed in a central portion thereof; a rising-up portion raised up substantially vertically from the base portion; and a grasping portion bent at an acute angle from the rising-up portion toward the base portion so as to cooperate with the base portion to grasp the sheets of paper or the like between the grasping portion and the base portion, the grasping portion including a contact portion formed at a portion facing at least an outer circumferential portion of the opening of the base portion for contacting with the sheets of paper or the like, and a lead-in portion extended from the contact portion to a top end portion and bent so as to come away from the base portion.

In the spring clip according to the present invention, one surface side, for example the back surface side, of sheets of paper or the like to be bound is put on the base portion while making the edge side of the sheets of paper or the like face the lead-in portion, and then the sheet of paper or the like are urged into the lead-in portion from the edge side thereof. When the sheets of paper or the like are urged, the base portion is bent downward since the base portion is comparatively easily transformed because of existence of its opening. Accordingly, the sheets of paper or the like can be easily inserted as they are up to the position where the edge portions of the sheets of paper or the like contact with the rising-up portion. Thus, the sheets of paper or the like are held elastically between the base portion and the grasping portion. This holding force depends directly on an elastic force produced between the opposite surfaces of the contact portion and the base portion, but the elastic force is weakened since the contact portion is partly opposite to the opening portion. Therefore, a frictional force produced at the contact portion when the clip is to be attached or detached is also small because the contacting area between the contact portion and the sheets of paper or the like. It is therefore possible to perform the attachment and detachment easily by hand. On the other hand, the grasping force depends on the elastic force of the material of the plate as mentioned above, it is possible to perform grasping by a sufficient force regardless of the state of the contact portion.

In the spring clip according to the present invention, preferably, the grasping portion is made shorter in length than the base portion, so that the base portion can be transformed only by applying a slight force thereto.

In the spring clip according to the present invention, preferably, an opening portion is formed also in the grasping portion so that the grasping portion as well as the base portion can be transformed to reduce the area where the spring clip contacts with the sheets of paper or the like to make it possible to perform the attachment/detachment to/from the sheets of paper or the like more easily.

BRIEF DESCRIPTION OF THE DRAWINGS

Other features and advantages of the present invention will be apparent from the following description taken in connection with the accompanying drawings, wherein.

DETAILED DESCRIPTION OF THE PREFERRED EMBODIMENTS

Embodiments of the spring clip according to the present invention will be described with reference to the drawings.

Figure 1:
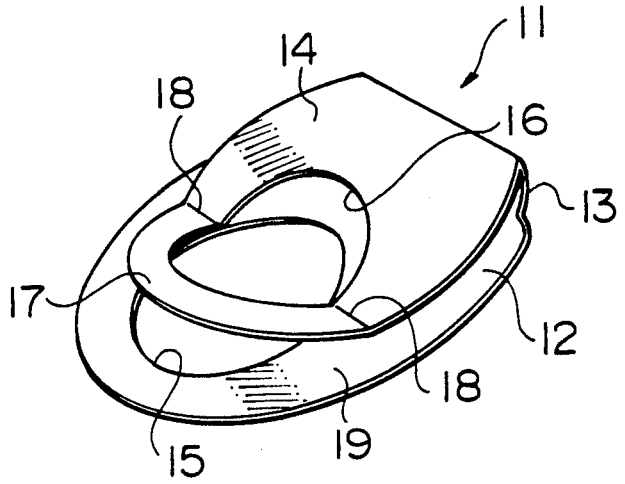
FIG. 1 is a perspective view illustrating a first embodiment of the spring clip according to the present invention.
Figure 2:
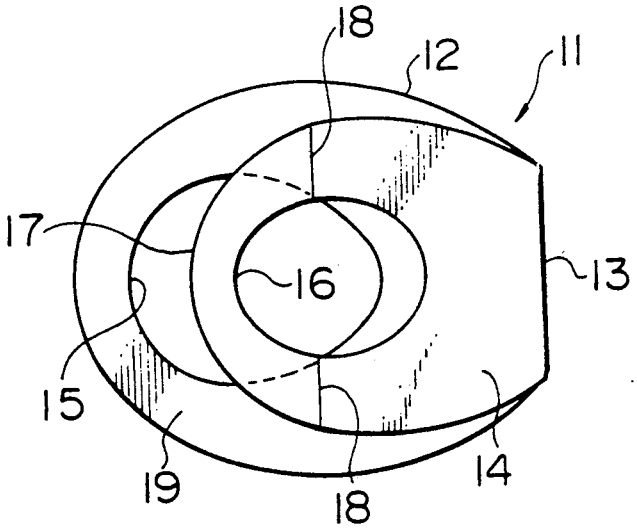
FIG. 2 is a plan view of the spring clip of FIG. 1.
Figure 3:
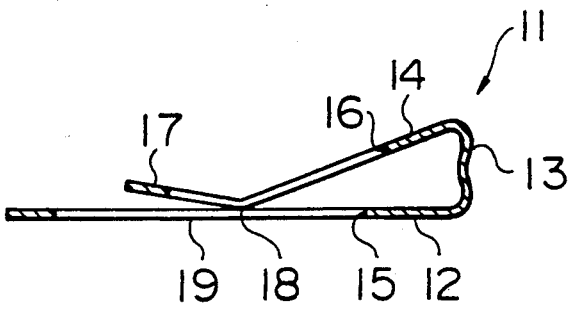
FIG. 3 is a longitudinally cross-sectional view of the spring clip of FIG. 1.

First, a first embodiment illustrated in FIGS. 1 to 3 will be described. A spring clip 11 is formed of, through punching and bending work, a sheet of metal plate material, having spring characteristic, such as stainless steel, phosphor bronze, iron, aluminum steel, etc. The spring clip 11 is basically constituted by a base portion 12, a rising-up portion 13 raised up vertically from the base portion 12, and a grasping portion 14 bent at an acute angle toward the base portion 12 from the rising-up portion 13. Opening portions 15 and 16 are formed in the base portion 12 and the grasping portion 14 respectively. The rising-up portion 13 is formed so as to be a circular arc which projects inwards substantially at the central portion thereof as shown in FIG. 3 to thereby increase the spring property for making the base portion 12 and the grasping portion 14 abut against each other. The grasping portion 14 is made to be shorter in length than and slightly narrower in width than the base portion 12. The top end portion of the grasping portion 14 is bent in the direction against the base portion 12 to form a lead-in portion 17, and a bent portion of the outer circumference of the opening portion 16 constitutes a contact portion 18 against the base portion 12. This contact portion 18 is opposite to an outer circumferential portion 19 of the opening portion 15 of the base portion 12 so as to grasp sheets of paper or the like between the outer circumferential portion 19 and the contact portion 18. The outer circumferential portion 19 of the base portion 12 is formed to be like a thin belt to give spring property to the base portion 12 itself.

In the spring clip 11 having such a configuration as mentioned above, the spring clip 11 is held on the rising-up portion 13 side by hand to make the lead-in portion 17 side opposite to a bundle of sheets of paper or the like, and the spring clip 11 is urged toward the bundle of sheets of paper or the like while the free end portion of the base portion 12 is made to abut against the back surface side of the bundle of sheets of paper or the like. Then, the outer circumferential portion 19 of the base portion 12 opens to produce a space between the base portion 12 and the contact portion 18 so that the bundle of sheets of paper or the like can be inserted up to the position where the edge portion of the bundle of sheets of paper or the like contacts with the rising-up portion 13. Consequently, the contact portion 18 is put on the upper surface of the bundle of sheets of paper or the like so as to grasp the bundle of sheets of paper or the like surely. When the spring clip 11 is to be detached, the rising-up portion 13 side is nipped by fingers and pulled so that the spring clip 11 comes off from the bundle of sheets of paper or the like. Thus, the spring clip 11 can be detached easily. Since the outer circumferential portion 19 of the base portion 12 is in the form of a thin belt, the base portion 12 can be bent extremely easily.

In such an operation of attachment and detachment of the spring clip 11, since the portions which come into contact with the bundle of sheets of paper or the like to grasp the latter are limited to part of the thin belt-like outer circumferential portion 19 and the linear contact portion 18 opposite thereto, the area of contact is so small that the frictional force at the time of attachment and detachment is small. Accordingly, the operation of attachment/detachment to/from the bundle of sheets of paper or the like by hand can be performed by a small force. Therefore, the spring clip 11 is more effective when the bundle of sheets of paper or the like is so thick that the elastic force of the spring plate becomes large. While the force to perform the operation of attachment and detachment is small, the elastic force of the spring plate constituting the spring clip 11 acts on the contact portion 18 as it is, in the state where the bundle of sheets of paper or the like is being bound by the spring clip 11. Accordingly, the bundle of sheets of paper or the like can be bound by a sufficient force. Although a portion of the contact portion 18 is made opposite to a portion of the outer circumferential portion 19 in this embodiment, not to say, the widthwise whole of the outer circumferential portion 19 may be made opposite to the contact portion 18 if the bundle of sheets of paper or the like is thin.

Figure 4:
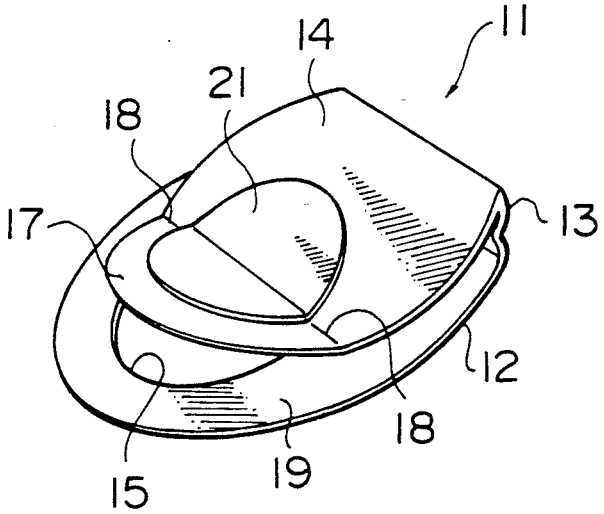
FIG. 4 is a perspective view illustrating a second embodiment of the spring clip according to the present invention.
Figure 5:
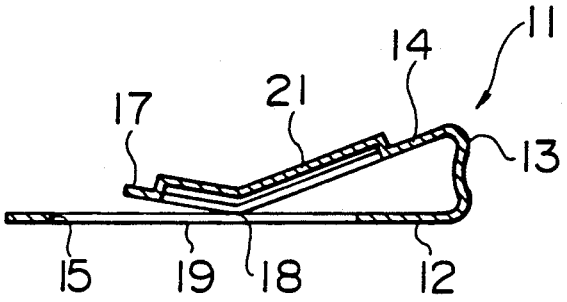
FIG. 5 is a longitudinally sectional view of the spring clip of FIG. 4.

In a second embodiment illustrated in FIGS. 4 and 5, in stead of provision of the opening portion 16 of the first embodiment, a raised portion 21 projecting upward is formed, by press working or the like, from the grasping portion 14 to the lead-in portion 17. By the provision of this raised portion 21, the strength can be ensured even in the case of using a thin spring plate, so that fingers are easy to get fast thereto at the time of attaching and detaching the spring clip 11 to thereby make the operation easy.

Figure 6:
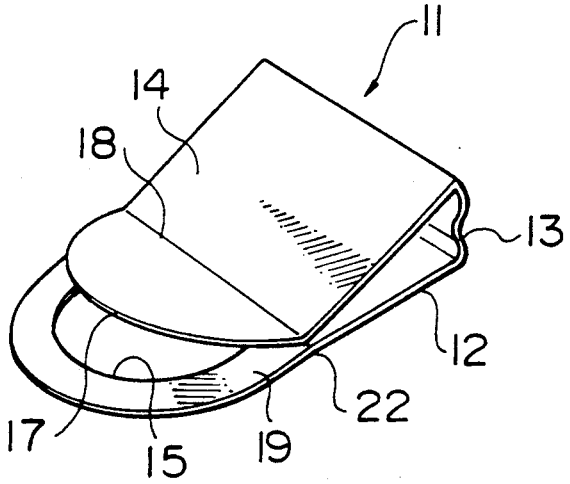
FIG. 6 is a perspective view illustrating a third embodiment of the spring clip according to the present invention.

In a third embodiment shown in FIG. 6, an opening portion 15 is provided only in a base portion 12, and a grasping portion 14 is formed into an even plate. An outer circumferential portion 19 of the opening portion 15 of the base portion 12 opposite to a linear contact portion 18 of the grasping portion 14 is bent slightly to project upward to form a lower contact portion 22. By such a configuration, the grasping portion 14 has an elasticity stronger than that in the first embodiment mentioned above, and at the same time, a strong grasping force is produced between the upper and lower contact portions 18 and 22, so that it is possible to grasp documents or the like more surely.

In those embodiments described above, no matter whether the opening portions 15 and 16 or the raised portion 21 is selected, they are formed by press working, so that there is only a difference between punching and drawing, and the depth of drawing is not deep, so that the number of working steps in a manufacturing process is not changed, and there is no difference in the point of cost. Further, although the base portion 12 and the grasping portion 14 are formed to be elliptic, not to say, they may be formed into various shapes such as circles, rectangles or the like.

Although the present invention has been described with reference to the preferred embodiments, the above description is for understanding the present invention, and the present invention can be changed and modified into various forms without departing from the spirit and the scope thereof as hereinafter claimed.

What is claimed is:

1. A spring clip formed by bending a single sheet of elastic metal plate for binding a plurality of sheet materials together, comprising:

a base portion having an opening formed in a central portion thereof;

a rising-up portion raised up substantially vertically from said base portion; and a grasping portion bent at an acute angle from said rising-up portion toward said base portion so as to cooperate with said base portion to grasp said sheet materials between said grasping portion and said base portion, said grasping portion including a contact portion formed at a portion facing at least an outer circumferential portion of said opening of said base portion for contacting with the sheet materials, an opening portion formed substantially in a center of the grasping portion including said contact portion, and a lead-in portion extended from said contact portion to a top end portion and bent so as to come away from said base portion.

2. A spring clip according to claim 1, wherein said rising-up portion has a circular arc portion which projects inward at its substantially central portion.

3. A spring clip according to claim 1, wherein said grasping portion is shorter in length than said base portion.

4. A spring clip according to claim 1, wherein a raised portion projecting upward is formed substantially in the center of said grasping portion.

5. A spring clip according to claim 1, wherein said base portion includes a lower contact portion formed by slightly bending said base portion to project upward at a position corresponding to said contact portion of said grasping portion.

6. A spring clip formed by bending a single sheet of elastic metal plate for binding a plurality of sheet materials together, comprising:

a base portion having an opening formed in a central portion thereof;

a rising-up portion raised up substantially vertically from said base portion; and a grasping portion bent at an acute angle from said rising-up portion toward said base portion so as to cooperate with said base portion to grasp said sheet materials between said grasping portion and said base portion, said grasping portion including contact portions formed at portions facing an outer circumferential portion of said opening of said base portion for contacting with the sheet materials, a raised portion formed in a center of the grasping portion and located between the contact portions, said raised portion projecting upwardly from the contact portions to increase strength of the grasping portion, and a lead-in portion extended from said contact portion to a top end portion and bent so as to come away from said base portion.

7. A spring clip according to claim 6, wherein said lead-in portion is bent across the raised portion.

8. A spring clip according to claim 7, wherein said raised portion includes a side wall projecting upwardly from and substantially perpendicularly to the grasping portion, and a flat surface portion formed on and inside the side wall, said surface portion being bent along the contact portion.

* * * * *